United States Patent [19]

Corsette

[11] 4,244,062

[45] Jan. 13, 1981

[54] LIQUID DISPENSER

[76] Inventor: Douglas F. Corsette, 6559 Firebrand St., Los Angeles, Calif. 90045

[21] Appl. No.: 954,851

[22] Filed: Oct. 26, 1978

[51] Int. Cl.[3] ..... E03D 9/02

[52] U.S. Cl. ..... 4/228; 239/59; 422/263; 422/266; D23/3

[58] Field of Search ..... 4/222, 227, 228; 222/485, 488, 489; 210/242 R; 422/266, 261, 274, 278, 263; D23/3; 239/51.5, 59

[56] References Cited

U.S. PATENT DOCUMENTS

| | | | |
|---|---|---|---|
| D. 231,985 | 7/1974 | Paulsen | D23/3 |
| 1,350,175 | 8/1920 | O'Connor | 422/266 X |
| 2,738,225 | 3/1956 | Meek | 422/266 X |
| 2,765,194 | 10/1956 | Will | 239/59 |
| 2,794,676 | 6/1957 | D'Agostino | 239/59 |
| 3,390,695 | 7/1968 | Van Beuren et al. | 422/266 X |
| 3,423,182 | 1/1969 | Klasky | 422/266 |
| 3,607,103 | 9/1971 | Kiefer | 210/242 R X |
| 3,766,570 | 10/1973 | Finneran | 4/228 X |
| 3,781,926 | 1/1974 | Levey | 4/228 |
| 3,965,497 | 6/1976 | Corsette | 4/228 X |
| 4,064,572 | 12/1977 | Wicks | 4/228 |

*Primary Examiner*—Stuart S. Levy

*Attorney, Agent, or Firm*—Watson, Cole, Grindle & Watson

[57] ABSTRACT

A liquid dispenser for a flush tank includes a dispensing closure in engagement with an open top container for axial movement relative thereto, the closure having discharge ports therein defining flow passages between the interior and exterior of the container and capable of being opened and closed during such axial movement. The closure includes a hollow cap having air vents therein, and a sleeve extending inwardly of the container so that liquid may flow during a tank refill operation through the ports and beneath the sleeve for thoroughly mixing with concentrated soluble material within the container before flowing into the cap while forcing the air through the vents. And, during a tank flushing operation, the mixed liquid is dispensed through the ports after it again mixes with the soluble material below the sleeve, the mixed liquid in the cap then being replaced by air through the vents during the discharge operation.

5 Claims, 8 Drawing Figures

LIQUID DISPENSER

BACKGROUND OF THE INVENTION

This invention relates generally to a liquid dispenser, and more particularly to such a dispenser for discharging a chemical concentrate from a container into the flush tank of a toilet after the tank liquid has been thoroughly mixed with the chemical concentrate within the container.

Toilet bowl cleaner dispensers have been developed for metering limited quantities of chemical concentrate from a container into a flush tank during the tank refill operation. U.S. Pat. No. Des. 231,985 discloses such a dispenser as having an outer member rotatable relative to the container and an inner ring secured to the top of the container. Since both the outer member and the ring have matching windows, which may be relatively more or less aligned in accordance with the desired opening, it appears from the disclosure of this patent that such controls the amount of concentrate dispensed during each flush cycle.

The interior of the dispensing closure is filled and purged through the windows around the top of the container, regardless of the effective size of the aligned openings, internal air being vented through holes in the top of the closure. As internal fluid concentrate is purged by gravity into the tank during discharge, air enters through these holes and, as the tank refills, the water being admitted forces the internal air out through these holes.

However, the control of the discharge of liquid concentrate from the container is effected by the size of the matching window openings. Liquid flow into the container is likewise controlled by the size of these openings. However, since the tank flush cycle is relatively faster than the tank refill cycle, it would be desirable to restrict the rate of flow during the discharge as compared to that during the refilling in order to avoid an undue amount of liquid concentrate from being flushed down the drain with the rushing tank water. And, the inlet through the dispenser openings should be sufficiently large to avoid any flotation problem of the dispenser, which flotation will persist until and unless sufficient liquid is admitted from the filling tank to prevent the tank level from rising appreciably above that within the dispenser. Moreover, since a solid chemical concentrate may be employed it must be dissolved quickly enough for the liquid adjacent thereto to reach a liquid concentrated condition, especially during frequent flushes wherein there is insufficient time between cycles for the solid concentrate to be dissolved fast enough. The prior art dispensers are incapable of effecting the degree of discharge control required and the thorough mixing of the liquid with the solid concentrate before discharge.

OBJECTS OF THE INVENTION

It is an object of the present invention to provide an improved toilet bowl chemical dispenser which effects positive discharge control of liquid concentrate, permits thorough mixing of the liquid with the chemical concentrate before discharge, is easy to operate and simple to manufacture, is economical and is of a one-piece construction engaged with an open top container provided for a quantity of concentrated soluble material.

Another object of the invention is to provide such a dispenser wherein the amount of discharge through a flow passage defined by at least one discharge port is adjusted, by means on the closure cooperating with the container, upon axial movement of the closure relative to the container.

A further object of this invention is to provide such a dispenser wherein means on the closure extend inwardly of the container to effect a thorough mixing of the liquid with the soluble material therebelow as it flows into the container through the flow passage during a tank refill operation, and mixed liquid also flowing into a hollow cap of the closure and thereafter again being mixed with the soluble material below the extending means before it is discharged during the tank flushing operation.

A still further object of this invention is to provide such a dispenser wherein the adjusting means includes a sleeve on the closure extending into and in contact with the container, the sleeve having openings therein extending outwardly and inwardly of an upper edge of the container, the size of the openings being adjustable relative to such edge upon the axial movement of the closure relative to the container.

A still further object of the present invention is to provide such a dispenser wherein the adjusting means includes a spring biased tab lying adjacent the discharge port and being moved to close and open the port upon relative axial movement of the closure and the container.

Other objects, advantages and novel features of the invention will become more apparent from the following detailed description of the invention when taken in conjunction with the accompanying drawings.

DETAILED DESCRIPTION OF THE INVENTION

Figure 1:
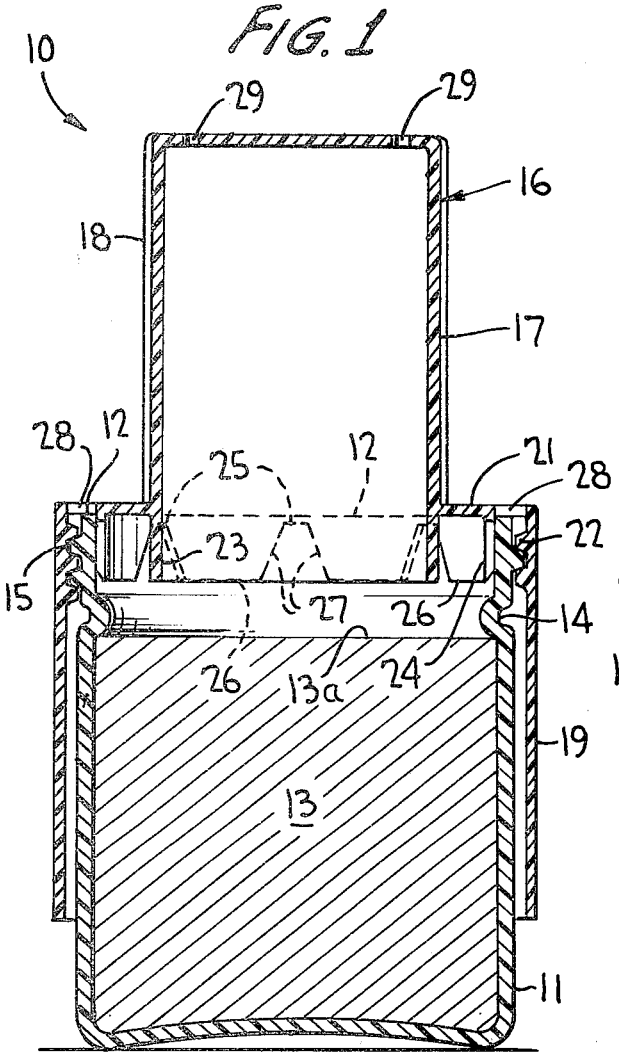
FIG. 1 is a vertical sectional view through a dispenser in accordance with one embodiment of the present invention, shown with the discharge ports closed.
Figure 2:
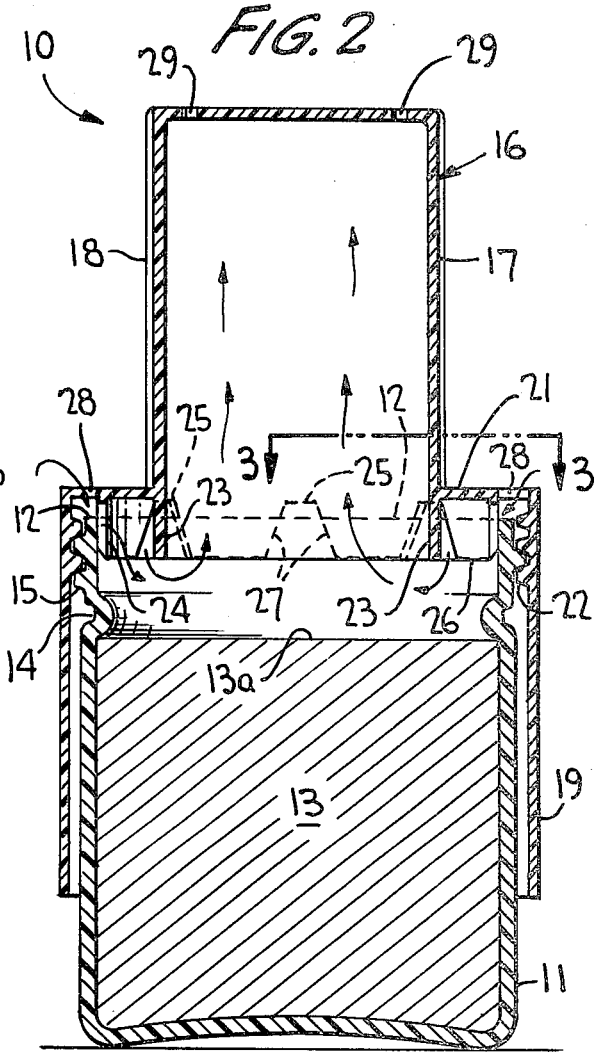
FIG. 2 is a view similar to FIG. 1 but showing the discharge ports open.

Turning now to the drawings wherein like reference characters refer to like and corresponding parts throughout the several views, a dispenser generally designated 10 is shown in FIGS. 1 and 2 in accordance with one embodiment of the invention. The dispenser includes a container 11 having a top opening and an upper edge 12 at such opening. The container is substantially filled to the level shown in any normal manner with a quantity of solid chemical concentrate 13, such being a concentrated soluble material capable of being dispensed as a liquid concentrate for disinfecting, deodorizing and cleaning a toilet bowl. An annular groove 14 provided in the container near the top serves no function in carrying out the invention; it being provided for the manufacture of the container which is of a standard, well-known variety. A plurality of exterior screw threads 15 are provided on the container between the groove and edge 12.

The dispenser further includes a dispensing closure, generally designated 16, as having a hollow cap 17 with vertical gripping serrations 18 thereon to enable a turning of the closure, and an outer skirt 19 interconnected with the cap by a horizontal, annular wall 21. The skirt is internally threaded as at 22 for threaded engagement with screw threads 15 of the container, so that the closure may be moved from its fully closed position of FIG. 1 of the container to an open condition of FIG. 2 by simply unscrewing the closure in a predetermined direction so as to effect axial movement of the closure relative to the container.

A first sleeve 23, forming an extension of cap 17, projects into the interior of the container and terminates a predetermined distance above level 13*a* of the chemical concentrate. The closure further includes a second sleeve 24 extending downwardly of wall 21, projecting inwardly into the container and axially spaced outwardly of sleeve 23 and into contact engagement with the inner wall of the container. A plurality of openings 25 extend inwardly of lower edge 26 of sleeve 24 so as to effectively form large serrations at the lower edge. Each opening, defined by downwardly diverging edges 27, lies just below edge 12 of the container opening when the closure is in a fully closed condition of FIG. 1. Openings 25 may be of other geometric configurations than shown, such as circles, ovals or open straight slots, without departing from the scope of the invention.

Figure 3:
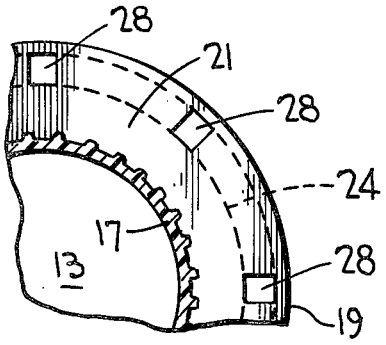
FIG. 3 is a cross-sectional view of the dispenser taken substantially along line 3—3 of FIG. 2.

And, a plurality of spaced discharge ports 28 are provided in wall 21 (see also FIG. 3), between sleeve 24 and skirt 19 so as to define flow passages together with openings 25, in an open condition of the closure, between the interior and exterior of the container. The discharge ports may alternatively be located at the junction between wall 21 and skirt 19, or in skirt 19 at the top thereof adjacent wall 21.

During handling and storage the closure is in its tightened condition over the container, as shown in FIG. 1. And, during assembly of the dispenser, any material 13 on the inner surface of the container near edge 12 is scraped clean by sleeve 24 which contacts this inner surface. When dispenser 10 is to be put into use, the closure is loosened relative to the container so as to axially move it to a position of FIG. 2 until openings 25 lie partially above edge 12. The dispenser is then submerged within the liquid of a toilet tank until the bottom of the container rests upon the bottom wall of the tank (not shown). Tank water then is admitted into the interior of the container through ports 28 and exposed openings 25, and thereafter enters the hollow cap, in the direction of the arrows, the water entering the cap forcing the internal air therein out through air vent openings 29 provided in the cap. And, during the tank flush cycle, the internal water is purged by gravity from the cap and the container into the tank through the discharge ports in a direction opposite the arrows shown in FIG. 2, air entering vents 29 during this process as the level of the tank water falls below that of the dispenser. In this respect, the operation of dispenser 10 is similar to that of U.S. Pat. No. Des. 231,985 described hereinabove. However, skirt 23 allows for a faster acquisition of equilibrium conditions within the dispenser. Thus, both the inflow and outflow of water circulates below end 26 of this skirt thereby resulting in a more thorough mixing of the water with material 13 both during the tank refill cycle and the tank flush cycle as the water abruptly changes its direction during its flow between opposite sides of skirt 23. Such action will therefore alleviate the deficiency encountered with frequent flushes wherein there is insufficient time between cycles for the solid concentrate to be dissolved fast enough for the liquid lying adjacent thereto to reach a liquid saturated chemical condition. This "scrubbing" action to which the chemical concentrate is subjected therefore provides a mechanical assist for enhancing a thorough mixing of the water with the solid chemical concentrate between flushes.

As to the control characteristics of the present arrangement, the tank water is permitted to flow during the tank refill cycle through ports 28, exposed openings 25, into the container and into the cap substantially unimpeded and at a sufficient rate of flow to prevent the water level in the tank from rising appreciably above that within the dispenser, thereby avoiding any dispenser flotation problem. However, since the flush cycle causes the water level to fall within the tank much faster than it rises, the restriction in the flow rate through the discharge ports of the dispenser prevents all of the liquid concentrate formed above material 13 from being discharged in synchronization with the falling tank level, since the flow of this mixed liquid is slightly impeded as it moves from the inner to the outer side of sleeve 23 by the adjustment of the size of openings 25. This lag causes more of the liquid concentrate to be left in the bowl rather than allowing it to go down the drain with the rushing tank water. And, since different tank flush valves leave different levels of water in the tank when the valve closes, this type of control can improve the efficacy of the treatment by getting the chemical into the bowl for residual treatment rather than losing it down the drain or retaining it in the tank to be lost during the next flush.

The metered amount of liquid chemical concentrate discharged from the dispenser is controlled by axial adjustment of the closure relative to the container. With a slight turn of the dispenser closure, for example counter-clockwise, the upper ends of openings 25 are disposed slightly above edge 12 of the container, and a further turning of the closure in the same direction will expose more and more of the openings above edge 12. The amount of such exposure may be observed through discharge ports 28 which may be disposed adjacent to respective openings. By reason of diverging walls 27, it can be seen that the exposure of the openings during axial shifting movement away from the container increases exponentially. Also, some suitable type of indexing may be provided on the closure and/or container for indicating the amount of exposure through openings 25.

Figure 4:
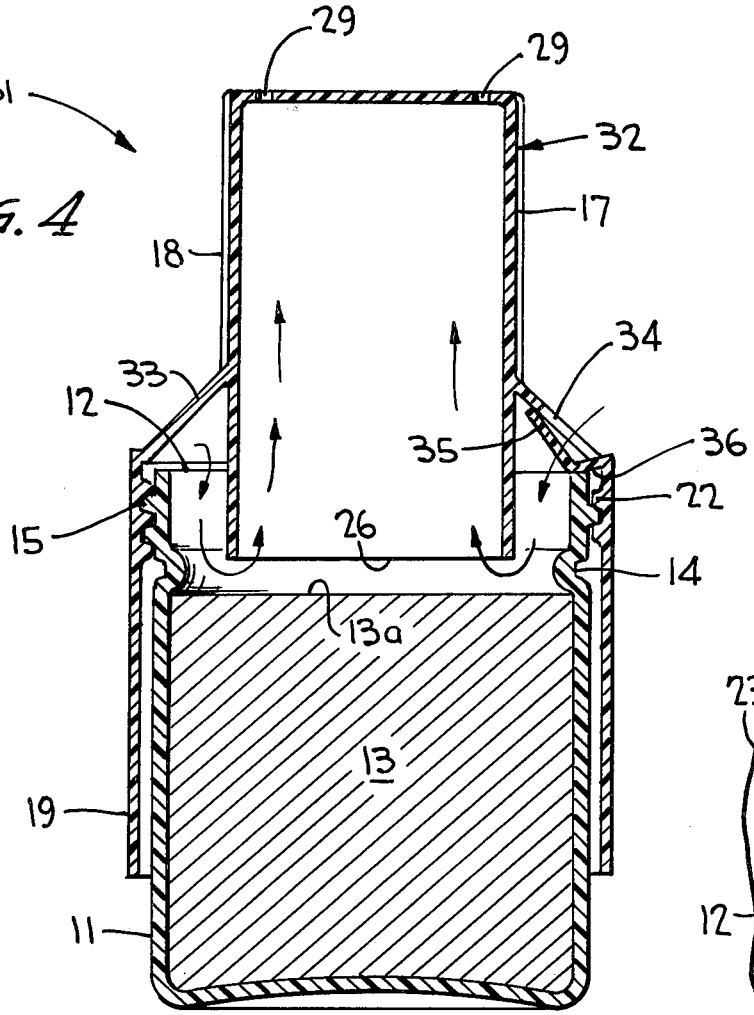
FIG. 4 is a vertical sectional view of a dispenser of another embodiment according to the invention, showing the discharge ports open.

FIG. 4 discloses a dispenser, generally designated 31, of another embodiment according to the invention. Elements in common with dispenser 10 will be similarly identified.

Dispenser 31 includes container 11 and a closure 32 threadedly engaged therewith for axial shifting movement upon relative rotation similarly as described with reference to dispenser 10. Closure 32 includes hollow cap 17, sleeve 23 extending into the interior of the container, and skirt 19. However, another type of means on the closure for adjusting the amount of discharge from the dispenser is provided, compared to that of the FIGS. 1 and 2 embodiment. Here, cap 17 and skirt 19 are interconnected by a conical wall portion 33 containing a plurality of spaced discharge ports 34. These ports are disposed between sleeve 23 and skirt 19, and define flow passages between the interior and exterior of the container as the tank liquid flows, in the direction of the arrows of FIG. 4, into the container and into the hollow cap during a tank refill cycle. As similarly described with reference to the first embodiment, such inward flow of the water forces the internal air out through air vents 29 as the flush tank fills. The water entering the container thoroughly mixes with the solid chemical concentrate as it circulates below end 26 of sleeve 23 while moving from the exterior to the interior of this sleeve. And, during the tank flush cycle, the liquid chemical concentrate is purged by gravity into the tank through the discharge ports as air entering vents 29 allows the water within the hollow cap to recede downwardly, opposite the direction of the arrows shown in FIG. 4, so as to again thoroughly mix with material 13 as it circulates below edge 26 and moves from the interior to the exterior of sleeve 23. This sleeve functions similarly as described with reference to the first embodiment in that it effects a lag in the amount of liquid chemical concentrate dispensed through the discharge ports during the tank flush cycle relative to the falling level of the water in the tank. Again, this type of control improves the treatment characteristics of the dispenser by discharging the liquid chemical concentrate into the toilet bowl for residual treatment rather than losing it down the drain or retaining it in the tank to be lost on the next flush of the tank.

Figure 8:
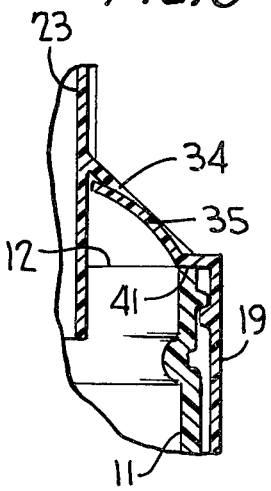
FIG. 8 is a view similar to FIG. 7 but showing the spring tab moved into a closing position relative to the discharge port.
Figure 5:
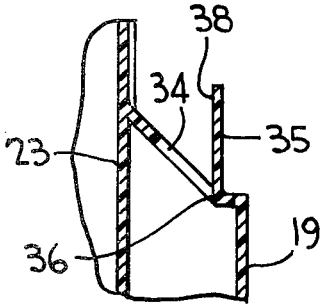
FIGS. 5 and 6 are, respectively, detail end and side views of a spring tab of the adjusting means of the FIG. 4 dispenser, shown when in a molded condition.
Figure 6:
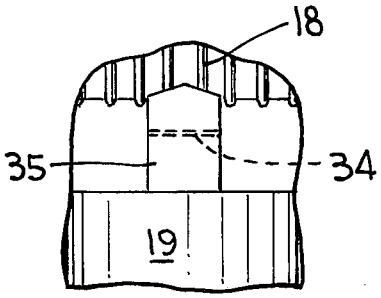
Figure 7:
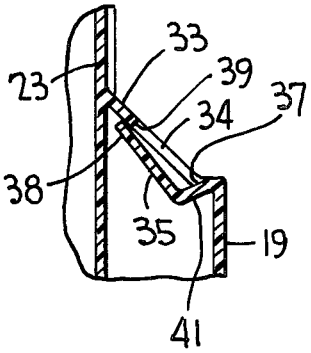
FIG. 7 is a detail view of the spring tab similar to FIG. 5 except that it is in engagement with the closure adjacent an edge of the discharge opening, when in use.

The size of the flow passages through discharge ports 34 is regulated by means of a spring tab 35 provided for each port and having a width substantially equal thereto. The tabs are molded in place during the molding operation of the closure so that an end 36 of each tab is connected to skirt 19 and, as shown in the initially molded and relaxed condition of FIG. 5, the remainder of the tab lies substantially parallel to the skirt. FIG. 6 is a side view of a typical tab relative to the closure in its initially molded and relaxed condition. Thereafter, during the assembly operation of the dispenser, each tab is forced through its respective discharge port so that an opposite end 38 thereof bears against an underside wall 33 adjacent an opposite edge 39 of the port, as clearly shown in FIG. 7. The tab between its opposite ends remains bowed inwardly toward the container, and defines a shoulder 41 which rests against edge 12 of the container, as shown in FIG. 4. As the closure is shifted axially relative to the container upon a turning thereof, increased pressure between shoulder 41 and edge 12 causes the tab to be forced into its discharge port, in the manner shown in FIG. 8, thereby reducing the flow passages around the tab. Fully advanced, the flow passage is essentially reduced to a closed position as the tab covers substantially the entirety of the discharge port. The dispenser may therefore be closed in a storage and handling condition, or the flow passages through the discharge port may be regulated upon a turning of the closure, in a direction to axially shift the closure relative to the container, depending on the amount of liquid chemical concentrate desired to be dispensed into the tank.

From the foregoing, it can be seen that a simple and economical yet highly effective dispenser has been devised for metering a liquid chemical concentrate into the flush tank of a toilet bowl while assuring a thorough mixing of the water with material 13 and effecting a slight lag in the dispensing thereof relative to the falling water level in the tank. The closures of each disclosed dispenser are of a single-piece construction and threadedly engage the container directly without the need for any ring member or the like, as in the prior art, to vary the flow passages through the discharge ports. Also, the size of the discharge ports shown in each embodiment may be readily observed during axial shifting movement of the closures.

The dispenser according to the invention can readily be re-cycled by transferring its closure to a refill container, or by installing a replacement solid cake 13 within the expired container, and no special skill is required. It is as simple as opening a conventional jar having a threaded cap, and re-setting the desired discharge openings is readily apparent by observing the amount of opening exposed at the discharge ports.

Obviously, many other modifications and variations of the present invention are made possible in the light of the above teachings. It is therefore to be understood that within the scope of the appended claims, the invention may be practiced otherwise than as specifically described.

I claim:

1. A liquid dispenser for a flush tank, comprising, a container having a quantity of concentrated soluble material therein capable of being dispensed as a liquid concentrate, said container having a top opening, a dispensing closure in engagement with said container for axial movement relative thereto, said closure including a hollow cap in communication with the interior of said container, said cap having air vents therein, said closure having at least one discharge port therein defining a flow passage between the interior and exterior of said container, said closure having a sleeve extending inwardly of the container in contact therewith for adjusting the amount of discharge through the flow passage upon axial movement of said closure relative to said container, said sleeve having at least one opening therein extending upwardly and downwardly of an edge at said top opening, said opening in said sleeve further defining the flow passage, the size of said sleeve opening being adjustable in relation to said edge upon the axial movement of said closure relative to the container, means on said closure extending from said cap into said container, and said discharge port being in open communication with the interior of said cap via said extending means and with the interior of said container, whereby liquid mixes below said extending means with the soluble material as it flows into the container through the flow passage from the tank during a tank refill operation, the mixed liquid also flowing into the cap thereby displacing air within said cap and forcing it through said air vents, and whereby the mixed liquid, during a tank flushing operation, is dispensed through the flow passage after it again mixes with the soluble material below said extending means, the mixed liquid in the cap being replaced by air through the vents.

2. A liquid dispenser for a flush tank, comprising, a container having a quantity of concentrated soluble material therein capable of being dispensed as a liquid concentrate, said container having a top opening, a dispensing closure in engagement with said container for axial movement relative thereto, said closure including a hollow cap in communication with the interior of said container, said cap having air vents therein, said closure having at least one discharge port therein defining a flow passage between the interior and exterior of said container, said closure having a first sleeve extending from said cap into the container, said closure having a second sleeve extending inwardly of the container in contact therewith for adjusting the amount of discharge through the flow passage upon axial movement of said closure relative to said container, said second sleeve having at least one opening therein extending upwardly and downwardly of an edge of said top opening, said opening in said second sleeve further defining the flow passage, the size of said second sleeve opening being adjustable in relation to said edge upon the axial movement of said closure relative to the container, and said discharge port being in open communication with the interior of said cap via said first sleeve and with the interior of said container, whereby liquid mixes below said first sleeve with the soluble material as it flows into the container through the flow passage from the tank during a tank refill operation, the mixed liquid also flowing into the cap thereby displacing air within said cap and forcing it through said air vents, and whereby the mixed liquid, during a tank flushing operation, is dispensed through the flow passage after it again mixes with the soluble material below said first sleeve, the mixed liquid in the cap being replaced by air through the vents.

3. The dispenser according to claim 1 or 2, wherein said closure is in threaded engagement with said container, whereby the axial movement is effected upon relative rotation of said closure and said container.

4. The dispenser according to claim 1 or 2, wherein said sleeve opening has downwardly diverging opposed edges intersecting with a bottom edge of said sleeve.

5. The dispenser according to claim 1 or 2, wherein a plurality of discharge ports are provided in said closure defining flow passages between the interior and exterior of said container.

* * * * *